United States Patent [19]

Anderka

[11] 4,102,584

[45] Jul. 25, 1978

[54] CAPILLARY TUBE PEN POINT

[75] Inventor: Gerold Anderka, Ellerbek, Fed. Rep. of Germany

[73] Assignee: Koh-I-Noor Rapidograph, Inc., Bloomsbury, N.J.

[21] Appl. No.: 748,606

[22] Filed: Dec. 7, 1976

[30] Foreign Application Priority Data

Dec. 20, 1975 [DE] Fed. Rep. of Germany ..... 2557705
Dec. 20, 1975 [DE] Fed. Rep. of Germany ..... 7540761

[51] Int. Cl.[2] ..... B43K 1/06
[52] U.S. Cl. ..... 401/259
[58] Field of Search ..... 401/258-260

[56] References Cited

U.S. PATENT DOCUMENTS 3,756,733 9/1973 Glasa et al. ..... 401/259

*Primary Examiner*—Stephen C. Pellegrino
*Attorney, Agent, or Firm*—David H. Semmes

[57] ABSTRACT

Capillary writing pen of the type embodying a cylindrical body having an open end and a pen tip with reservoir insertable as a cartridge within the cylindrical body. Particularly the improvement consisting of providing wave like complemental surfaces at the abutting interface of the cylinder open end and cartridge tip, such that transverse twisting of the cartridge with respect to the cylinder results in axial separation of the cartridge with respect to the cylinder. The improvement eliminates the necessity for the expensive and time consuming complemental threading of the cylinder interior and cartridge exterior and is readily producible in conventional plastic dies.

6 Claims, 4 Drawing Figures

CAPILLARY TUBE PEN POINT

BACKGROUND OF THE INVENTION

A. The Prior Art

West German Pat. DT-AS 2 159 522 has a cylindrical body provided along its front end with a writing tube wherein the falling weight with the cleaning wire is passed through an internal boring. In addition, this cylindrical body has a groove facing outward, which can be inserted into a cartridge element which has along its inner surface an ink compensating chamber. The aligning surfaces between the cartridge element and the cylindrical shell are slightly conical relative to each other, so that the cartridge element can be released from the mounting walls after a brief axial movement in respect to the cylindrical shell. In this fashion it can be pulled from the cylindrical shell without further difficulties.

Since, as a result of dried ink, it can happen that the shell element becomes glued along the frontally opened slot of the cylindrical shell and then cannot be released by simple pulling, this already known capillary tube pen point is provided with a thread consisting of a number of protruding thread courses in the front part of the cartridge element as well as correspondingly recessed threads in the frontal part of the cylinder shell. This allows for only a limited insertion of the cartridge element up to a given depth into the annular tee-slot which faces forward. In order to have acomplete and satisfactory insertion, a screwlike motion is required. By utilizing such a thread arrangement and as a result of the required screw-like turn, it is possible to achieve — by properly turning the cartridge element — a force, acting in the axial direction that will affect a separation of aligning surfaces of cylinder shell and cartridge element. However, this thread arrangement makes more difficult the insertion of the cartridge element into the cylinder shell. Furthermore, this type of construction requires special dies when using the injection mold process and this causes an increase in the production costs.

SUMMARY OF THE INVENTION

The object of the present invention, on the other hand, is to create a capillary pen point of simple construction which will allow a simple separation of cylinder shell and cartridge element without the use of special instruments as, for example, a tapered key.

This invention solves the problem with a capillary pen point of the type initially described in so far that along a rearward facing surface of the cartridge element and along a correspondingly forward facing surface of the cylinder shell, wedge shaped surfaces are provided which run obliquely in the axial direction.

These wedge surfaces make it possible that a simple rotation movement will cause a separation of the cylinder shell and the cartridge element in an axial direction. This is true, as the rotary movement will cause the wedge surfaces to slide against each other and produce a force component acting in the radial direction.

The arrangement of the wedge surfaces on the rearward facing surfaces of the cartridge element or the forward facing surfaces of the cylinder shell, as for example, a layout along the rear face of the cartridge element, makes it possible to produce these surfaces very easily by means of an injection molding process. Above all, the surfaces will not come in contact with the ink, so that there will be no danger That dried ink will become deposited in the area of the wedge surfaces.

The wedge surfaces can be given wave-like shapes which can stretch along the entire circumference of the cartridge elememt or cylinder shell. Especially well suited wave shapes are saw tooth, triangular, and sinusoidal curves.

When wave shaped wedge surfaces are used it is generally necessary that the cylinder shells and cartridge elements are fairly accurately aligned when they are joined together. This is necessary in order to assure a proper fitting of the wedge surfaces. In order to make such an accurate alignment unnecessary, it is possible that the wedge surfaces of the cartridge element of the cylinder shell be limited in its sideward movement by a longitudinal depression running along the circumference, while wedge surfaces of the cylinder shell or the cartridge element ae limited in their lateral movement by a protrusion running along the axial direction. This protrusion along the circumference is considerably shorter than the length of the depression along the circumference. In this kind of layout, it is sufficient that the cartridge element and cylinder shell are aligned so that the protrusion is placed anywhere into the recess.

This invention will be explained in detail with the aid of the schematic arrangements below.

BRIEF DESCRIPTON OF THE DRAWINGS

DESCRIPTION OF THE PREFERRED EMBODIMENTS

Figure 1:
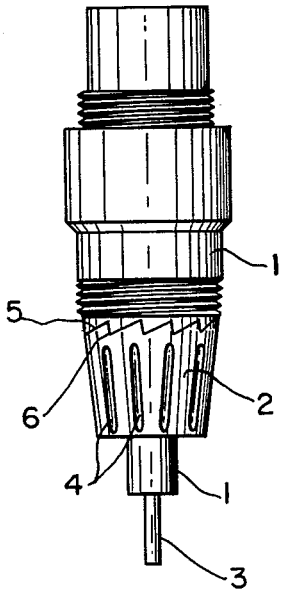
FIG. 1 depicts a view of the capillary tube pen point made pursuant to the invention in which the wedge surfaces have the shape of a saw tooth orbit.
Figure 3:
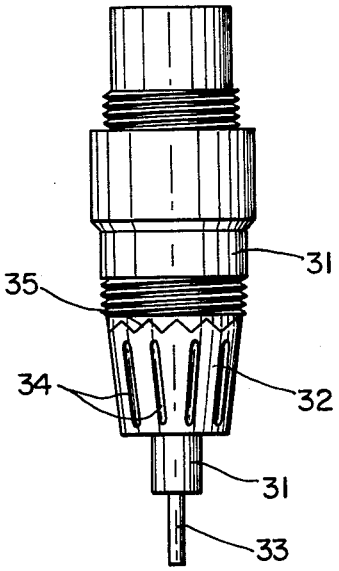
FIG. 3 depicts a view corresponding to FIGS. 1 and 2, in which the capillary tube pen point is provided with wedge surfaces having the shape of an orbital triangular wave.
Figure 4:
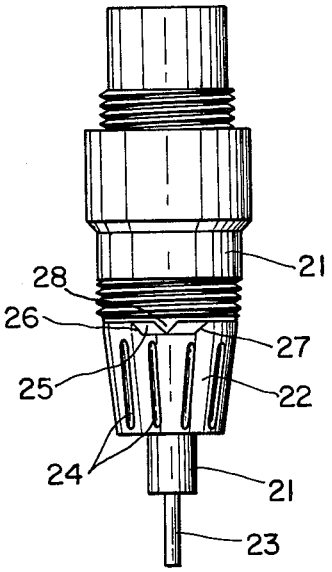
FIG. 4 depicts a view similar to FIGS. 1–3 and showing another wedge form.

The capillary tube pen point shown in FIG. 1 corresponds in its structure somewhat to the capillary tube pen point shown in FIGS. 3 and 4 of DT-AS 2 159 522, in which case, however, the thread provided for the aforementioned capillary tube pen point, between the cartridge element and the cylinder shell, is missing.

The depicted cylindrical shell 1 reaches forward up to the pen point capillary 3. Into this cylinder shell is inserted from the front, a cartridge element 2. Not shown is the annular tee-slot facing forward. The cartridge element 2 is wedge shaped in front and provided with grip depressions 4. This cartridge element rests with a circumferential surface that faces rearwards, onto a circumferential surface of the cylindrical shell 1 that faces forward. These circumferential surfaces are, shown, provided with saw tooth shapes. That is, they form alternatingly, long, and in axial direction oblique wedge surfaces 5, and short, transitional surfaces 6, which run parallel to the longitudinal axis of the cylinder shell.

It is immediately evident that on turning the cylinder shell 1 against the cartridge shell 2, for example, by holding the cylinder while grasping and turning the cartridge element in the area of the grip depressions 4, the wedge surfaces 5 will slide on each other. This will generate a force in the axial direction which will separate the cylinder shell from the cartridge element so that the cartridge element 2, after a brief turning movement, can be withdrawn or pulled out of the cylinder shell 1.

A turning in the opposite direction is prevented by the wedge shaped surface 6 which has a defined final position.

Figure 2:
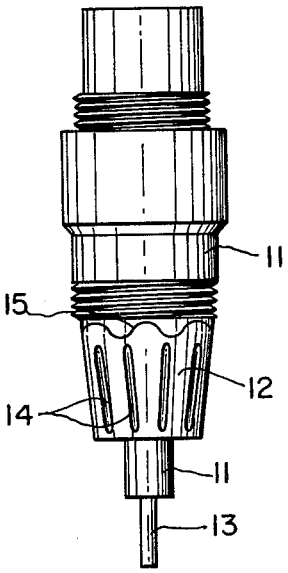
FIG. 2 depicts a view corresponding to FIG. 1, in which the capillary tube pen point is provided with a sinusoidal shape wedge surface.

The arrangement that is depicted in FIG. 2 involves a cylinder body 11 with a capillary pen point 13 and a cartridge element 12. The cartridge element 12 is inserted through an annular tee-slot which is not shown. The cartridge element has grip depressions 14 along its frontal wedge shaped region. The wedge surfaces 15 have, in this layout, the shape of an orbital sinusoidal wave. It is immediately clear how these wedge surfaces perform the same function as the wedge surfaces 5 in the example shown in FIG. 1. In the present case however, the rotation of the cartridge element 12 relative to the cylinder shell 11 can be made in any desired direction as both directions produce a wedge effect. That is, a separating force is generated that acts in an axial direction.

The arrangement shown in FIG. 3 differs from the layout shown in FIG. 1 only in the different shape assigned to the wedge surfaces which are given the shape of a triangular wave. It follows that the cylinder body 31 which carries the writing capillary 33 and the cartridge element 32 with the grip depressions 34, can be rotated against each other in both directions so that the appropriately slanted wedge surfaces 35 will separate these parts from each other.

In the example shown in FIG. 4, the cylinder body 21 which carries the writing capillary 23 and the cartridge element 22 with the grip depressions 24, are constructed in the previously described fashion. They differ from the parts used in those examples only in the shape of the wedge surfaces.

As shown, the rearward facing circumferential surface of the cartridge element 2 is provided with a depression 25 which runs longitudinally with respect to the circumferential direction. The side surfaces 26, 27, which run obliquely in an axial direction, serve as wedge surfaces. The cylinder shell is provided with an axially extending wedge shaped protrusion 28, which is located along a forward facing circumferential surface. Preferably, this protrusion has the same declination as the limiting surfaces 26, 27. The protrusion 28, in the circumferential direction, is considerably shorter than the depression 25 in this axial direction.

When joining the cylinder shell 21 and the cartridge element 22, it is simply necessary that they be aligned so that the protrusion 28 enters the depression 25 along any point. To separate the two, the cylinder shell 21 and the cartridge element 22 are turned against each other until one side surface of the protrusion 28 makes contact with the wedge surface 26 or 27. When the rotation continues, a separating force is generated in the axial direction such that the axial separation of cylinder shell cartridge element is effected in the same manner as described earlier.

I claim:

1. In a capillary writing pen of the type having a cylindrical body portion with an open end a writing pen tip with reservoir and a cartridge shell which is fitted within the cylindrical body such a that a rearward surface of the cartridge shell and the open end of the cylinderical body axially abut each other, while the pen tip extends axially thereof for writing purposes, the improvement comprising:

A. Complemental wave-like surfaces formed in the abutting open end of the cylindrical body and the rearward surface of the cartridge shell such that lateral twisting of said cartridge shell with respect to said cylindrical body results in axial separation of said cartridge shell with respect to said cylindrical body.

2. A capillary pen, improved as in claim 1, wherein said wave-like surfaces are in the form of a plurality of axially inclined wedge surfaces with intervening and longitudinally extending lock surfaces.

3. A capillary writing pen, improved as in claim 1, wherein said wave-like surfaces are sinusoidal.

4. A capillary writing pen improved as in claim 1, wherein said wave-like surfaces are in sawtooth configuration.

5. A capillary writing pen improved as in claim 1, wherein the wave-like surface in said cartridge shell is in the form of a laterally extending axial depression and said wave-like surface in said cylindrical body is in the form of an axially extending protrusion complementally and laterally movable within said depression.

6. A capillary writing pen improved as in claim 1, wherein said cartridge shell includes longitudinally extending grip depressions.

* * * * *